US008973181B2

(12) United States Patent
Thorne et al.

(10) Patent No.: US 8,973,181 B2
(45) Date of Patent: Mar. 10, 2015

(54) WHEEL ASSEMBLY FOR A FOLDABLE CHILD ENCLOSURE

(71) Applicant: Thorley Industries LLC, Pittsburgh, PA (US)

(72) Inventors: Henry F. Thorne, West View, PA (US); Jared A. Rosenthal, Pittsburgh, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 0 days.

(21) Appl. No.: 13/794,949

(22) Filed: Mar. 12, 2013

(65) Prior Publication Data

US 2013/0277948 A1 Oct. 24, 2013

Related U.S. Application Data

(60) Provisional application No. 61/636,111, filed on Apr. 20, 2012.

(51) Int. Cl.
*A47D 7/01* (2006.01)
*A47D 13/06* (2006.01)

(52) U.S. Cl.
CPC ..... *A47D 13/061* (2013.01); *A47D 13/063* (2013.01)
USPC ..... 5/99.1; 280/639

(58) Field of Classification Search
CPC ..... A47D 13/06–13/068
USPC ..... 5/99.1; 301/64.706–64.707, 43, 53; 280/639
See application file for complete search history.

(56) References Cited

U.S. PATENT DOCUMENTS

| | | | | |
|---|---|---|---|---|
| 2,670,477 | A | | 3/1954 | Pond |
| 2,825,071 | A | | 3/1958 | Landry et al. |
| 3,062,254 | A | * | 11/1962 | Keefe ..... 152/7 |
| 3,119,124 | A | | 1/1964 | Krauss |
| 3,206,773 | A | | 9/1965 | Sarasin |
| 3,309,718 | A | | 3/1967 | Sarasin |
| 3,430,273 | A | | 3/1969 | Stillwaugh |
| 3,848,278 | A | | 11/1974 | Propst |
| 4,811,437 | A | | 3/1989 | Dillner et al. |
| 4,819,285 | A | | 4/1989 | Fetters |
| 4,837,875 | A | | 6/1989 | Shamie et al. |
| 4,985,948 | A | | 1/1991 | Mariol |
| 5,025,517 | A | | 6/1991 | Johnson |
| 5,197,154 | A | | 3/1993 | Shamie |
| 5,239,714 | A | | 8/1993 | Huang |
| 5,241,716 | A | | 9/1993 | Kohus |
| 5,243,718 | A | | 9/1993 | Shamie |
| 5,279,006 | A | | 1/1994 | Teng |
| 5,293,656 | A | | 3/1994 | Chan |
| 5,353,451 | A | | 10/1994 | Hsiung |
| 5,358,220 | A | | 10/1994 | Yu-Kuang |

(Continued)

*Primary Examiner* — Jeffrey J Restifo
*Assistant Examiner* — Erez Gurari
(74) *Attorney, Agent, or Firm* — The Webb Law Firm

(57) ABSTRACT

A foldable structure includes: an upper assembly forming an upper portion of the structure; a base assembly forming a lower portion of the structure; a centrally-located hub assembly operatively connected to the base assembly; and a post extending from each corner of the upper assembly to a corner of the base assembly. At least one rotatable wheel assembly is provided at each corner of the lower portion of the structure extending from the structure to engage a surface. Each wheel assembly includes at least one support surface adapted for supporting and guiding the wheel on a surface and at least one groove provided on opposing sides of the support surface.

18 Claims, 11 Drawing Sheets

(56) References Cited

U.S. PATENT DOCUMENTS

| | | | |
|---|---|---|---|
| 5,363,521 | A | 11/1994 | Garland et al. |
| 5,367,725 | A | 11/1994 | Tsai |
| 5,381,570 | A | 1/1995 | Cheng |
| D359,869 | S | 7/1995 | Oren |
| 5,504,951 | A | 4/1996 | Yeh |
| 5,513,399 | A | 5/1996 | Weng |
| 5,530,977 | A | 7/1996 | Wang |
| 5,615,427 | A | 4/1997 | Huang |
| 5,809,592 | A | 9/1998 | McAllister |
| 5,867,851 | A | 2/1999 | Mariol et al. |
| 5,911,653 | A | 6/1999 | Cheng |
| 6,125,483 | A | 10/2000 | Stroud et al. |
| 6,256,814 | B1 | 7/2001 | Drobinski |
| 6,317,907 | B1 | 11/2001 | Wang |
| 6,336,234 | B1 | 1/2002 | Kuo |
| 6,343,390 | B1 | 2/2002 | Yang et al. |
| 6,357,462 | B1 | 3/2002 | Laosunthara et al. |
| 6,421,850 | B1 | 7/2002 | Welsh, Jr. |
| 6,473,919 | B1 | 11/2002 | Wang |
| 6,510,568 | B1 | 1/2003 | Drobinski et al. |
| 6,634,038 | B2 | 10/2003 | Hsia |
| 6,684,420 | B2 | 2/2004 | Koenig et al. |
| 6,851,135 | B1 | 2/2005 | Chen |
| 7,043,779 | B2 | 5/2006 | Mendenhall et al. |
| 7,069,605 | B2 | 7/2006 | Harvey, III |
| 7,343,634 | B2 | 3/2008 | Song |
| 2003/0061657 | A1 | 4/2003 | Longenecker et al. |
| 2006/0021137 | A1 | 2/2006 | Waldman et al. |
| 2006/0021138 | A1 | 2/2006 | Waldman et al. |
| 2006/0037137 | A1 | 2/2006 | Song |
| 2006/0174406 | A1 | 8/2006 | Yang |
| 2006/0185082 | A1 | 8/2006 | Casati Troutman |
| 2006/0225204 | A1 | 10/2006 | Bretschger et al. |
| 2006/0225208 | A1 | 10/2006 | Chen |
| 2007/0017025 | A1* | 1/2007 | Myer ..... 5/99.1 |
| 2007/0157379 | A1 | 7/2007 | Lin |
| 2007/0163041 | A1 | 7/2007 | Cheng et al. |
| 2007/0277308 | A1 | 12/2007 | Chen et al. |

* cited by examiner

WHEEL ASSEMBLY FOR A FOLDABLE CHILD ENCLOSURE

CROSS-REFERENCE TO RELATED APPLICATIONS

The present application claims priority to U.S. Provisional Patent Application No. 61/636,111, filed Apr. 20, 2012, entitled "Wheel Assembly for a Foldable Child Enclosure". The entire disclosure of this application is incorporated by reference herein.

BACKGROUND OF THE INVENTION

1. Field of the Invention

The present invention relates generally to a foldable child enclosure, such as a play yard, playpen, or crib apparatus, and, more particularly, to a child enclosure apparatus having a wheel assembly adapted for supporting the child enclosure apparatus and facilitating movement on a plurality of surfaces.

2. Description of Related Art

Foldable play yards, playpens, and crib devices are well-known, as perhaps best exemplified by U.S. Pat. No. 4,811,437 for a "Foldable Playyard" to Dillner et al. The foldable device disclosed therein is light in weight and, when collapsed, a fairly convenient compact package. One major problem with such devices, however, is that they are difficult to handle because they are cumbersome to open and unwieldy to fold with clumsy operating mechanisms. Additionally, they are difficult to move across a variety of surfaces, such as smooth floors and thick carpet. Another device is shown in an application, U.S. Patent Application Publication No. 2007/0017025, for a "Folding Play Yard" by Myer. There is no disclosure in this reference concerning a wheel assembly for facilitating movement of the play yard on a variety of surfaces. The release means play no part in such a movement.

A more easily operated device that opens and folds smoothly is desirable, especially for those users doing so while attention is being directed to young children. An efficient, low weight, and robust structure is also desirable. In addition, a further need exists for such a play yard that includes a wheel assembly adapted for supporting the play yard and facilitating movement on a plurality of surfaces.

SUMMARY OF THE INVENTION

Accordingly, an object of the present invention is to provide a foldable structure, such as an enclosure for a child, that can be easily operated to open and fold in a fast and smooth manner, and that can be pushed over a plurality of different surfaces with little effort on the part of the user. More specifically, the foldable structure of the present invention advantageously provides a one-step process to open or fold the enclosure, where pushing down on or lowering of a centrally-located hub assembly opens the structure, and pulling up on or raising the hub assembly folds the structure.

According to one embodiment of the invention, the foldable structure may include: an upper assembly forming an upper portion of the structure; a base assembly forming a lower portion of the structure; a centrally-located hub assembly operatively connected to the base assembly; and a post extending from each corner of the upper assembly to a corner of the base assembly, thereby forming the structure. The upper assembly may include a plurality of arm assemblies. A wheel assembly may be provided at each corner of the base assembly extending from the base assembly to engage a surface. Movement of the hub assembly towards a surface upon which the foldable structure is positioned desirably causes the foldable structure to move from a folded position to an opened position, and movement of the hub assembly away from the surface desirably causes the foldable structure to move from the open position to the folded position. The hub assembly may be operatively connected to the at least one latching mechanism by an operating structure. Movement of the hub assembly towards a surface upon which the foldable structure is positioned may cause the operating structure to force the at least one latching mechanism into a locked position, and movement of the hub assembly away from the surface causes the operating structure to force the at least one latching mechanism into a released position. The operating structure may be configured as a cable or any other suitable operating device. The posts may be hollow, and the operating structure may extend from the hub assembly to the at least one latching mechanism through at least one of the posts. The base assembly may include upper and lower base legs in an X-shaped configuration.

Each wheel assembly may include: a wheel body having a central axis about which the wheel assembly rotates; at least one support surface adapted for supporting and guiding the wheel on a surface; and at least one groove provided on opposing sides of the support surface. The at least one groove may be recessed with respect to the at least one support surface. Each support surface desirably has a pair of faces extending on opposing sides of the support surface. A plurality of support surfaces are separated by a plurality of grooves. The wheel may be configured such that one or both faces are angled or perpendicular relative to a plane of the support surface.

According to another embodiment of the invention, the foldable structure may include: an upper assembly having a plurality of upper arms; a base assembly having a plurality of base legs; a side structure having a plurality of side posts connecting the upper assembly to the base assembly; a centrally-located hub assembly that causes the apparatus to move between a closed position and an open position; and a wheel assembly provided at each corner of the base assembly. The structure is prevented from moving from an open position to a closed position by at least one latching mechanism provided on at least one corner of the upper assembly. The structure is movably supported on a surface by the plurality of wheel assemblies.

According to still another embodiment of the invention, each wheel assembly may include: a wheel body having a central axis about which the wheel assembly rotates; at least one support surface adapted for supporting and guiding the wheel on a surface; and at least one groove provided on opposing sides of the support surface. The at least one groove may be recessed with respect to the at least one support surface. Each support surface desirably has a pair of faces extending on opposing sides of the support surface. The grooves may be adapted for engaging an operating structure, such as at least one cable.

According to yet another embodiment of the invention, a foldable structure may include: an enclosure defining a space within; a hub assembly centrally located at a bottom of the structure; and at least one wheel assembly provided at each corner of the foldable structure. Each wheel assembly may include a wheel body having a central axis about which the wheel assembly rotates; at least one support surface adapted for supporting and guiding the wheel on a surface; and at least one groove provided on opposing sides of the support surface. The at least one groove may be recessed with respect to the at least one support surface. The grooves may be adapted for engaging an operating structure, such as one or more cables.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
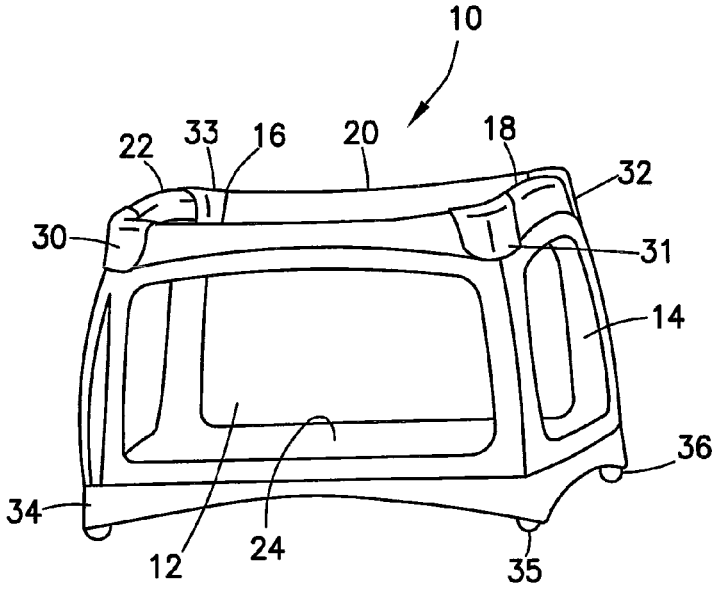
FIG. 1 is a perspective view of a foldable structure shown in an opened or deployed position in accordance with one embodiment of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
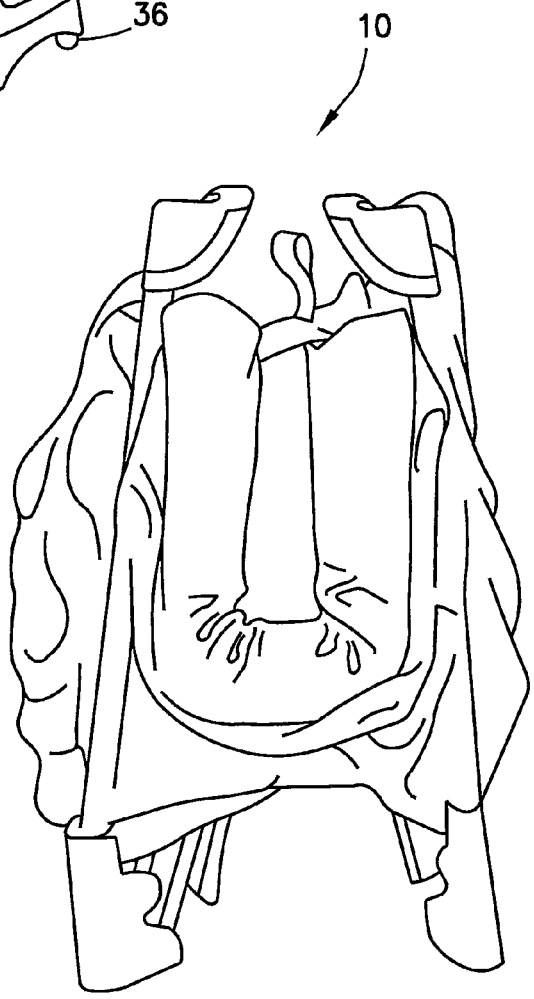
FIG. 2 is a perspective view of the structure shown in FIG. 1 in a folded or closed position.

With reference to FIGS. 1 and 2, a foldable child enclosure apparatus 10 configured in the form of a play yard or playpen is illustrated. The play yard is portable and, as such, is foldable, closable, or collapsible so as to move between an opened, deployed position, as shown in FIG. 1, for use, and a folded, collapsed, or closed position as shown in FIG. 2, for transport and/or storage. The play yard may have soft, flexible mesh sides, such as sides 12, 14, fabric coverings, such as fabric coverings 16, 18, 20, 22, a base pad or mattress 24, and decorative and protective upper and lower corners, such as the four upper corners 30, 31, 32, 33, and the four lower corners, of which only three lower corners 34, 35, 36 are shown. Side padding (not shown) may also be placed around the interior of the play yard for added protection of a child placed on the pad or mattress 24. Storage devices, child seats, bassinets and the like may also be mounted on and to the play yard although they are not shown here. Under the mesh, the fabric, the pad, and any side padding is a foldable frame, denoted generally as reference numeral 40, as shown in an opened position in FIG. 3, a partially-opened position in FIG. 4, and in a folded position in FIG. 5.

Figure 3:
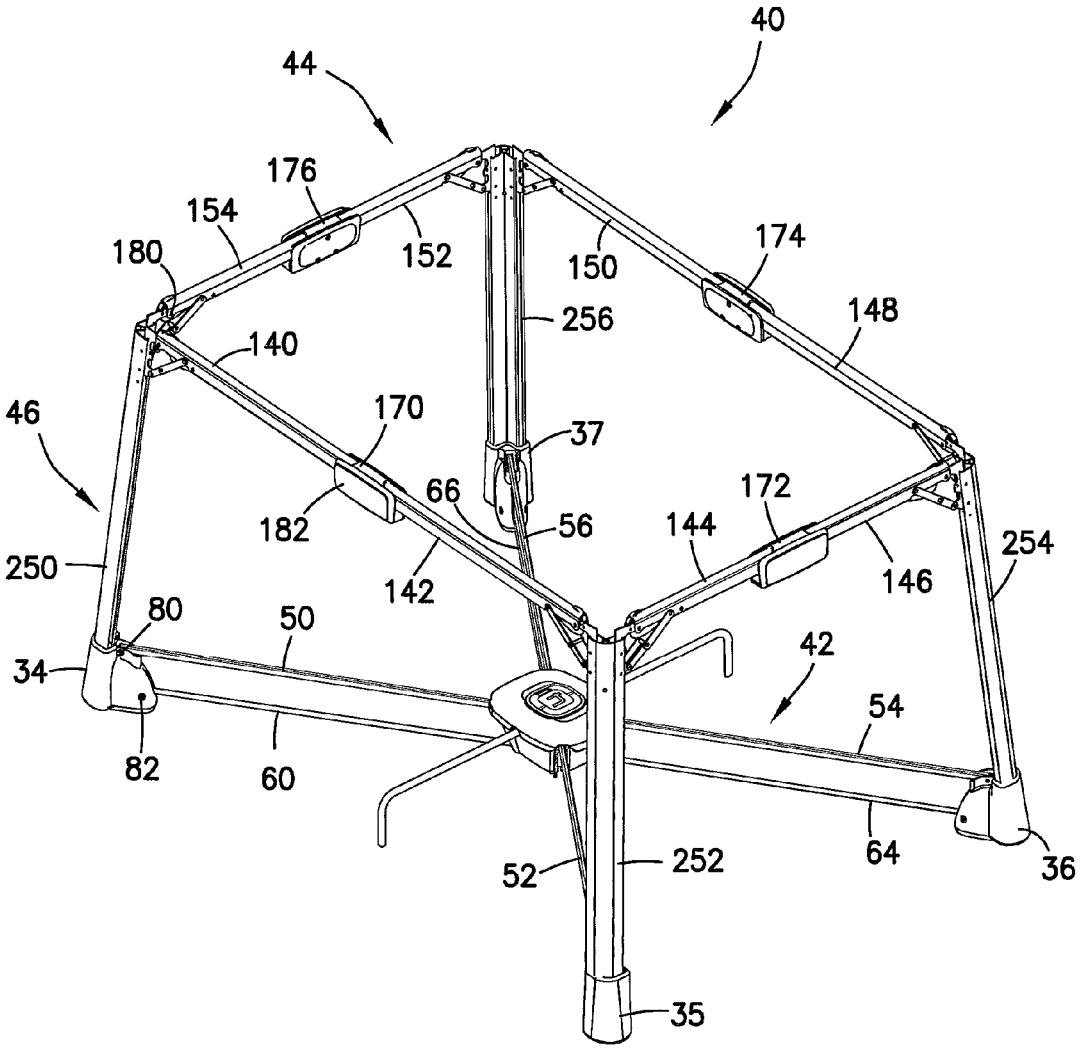
FIG. 3 is a perspective view of a frame of the foldable child structure shown in FIG. 1 in an opened position.
Figure 4:
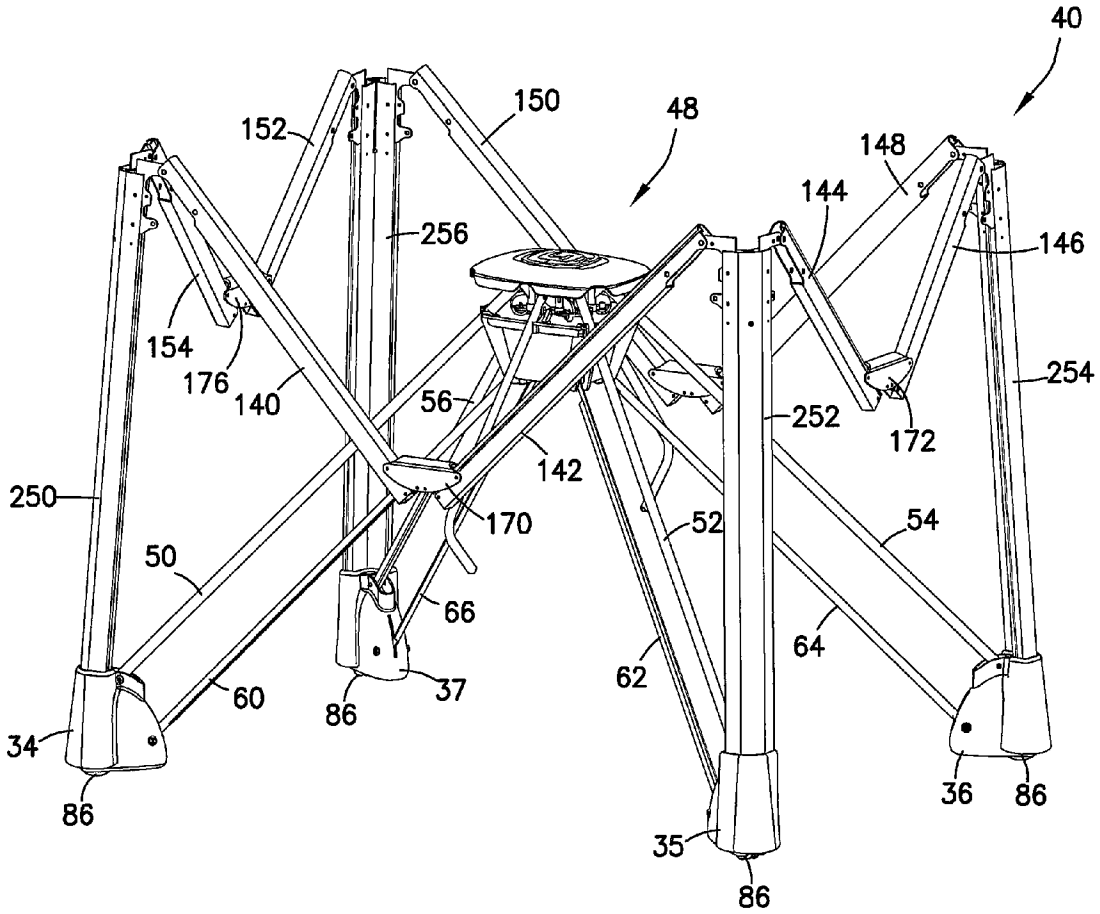
FIG. 4 is a perspective view of the frame in a partially-opened position.
Figure 5:
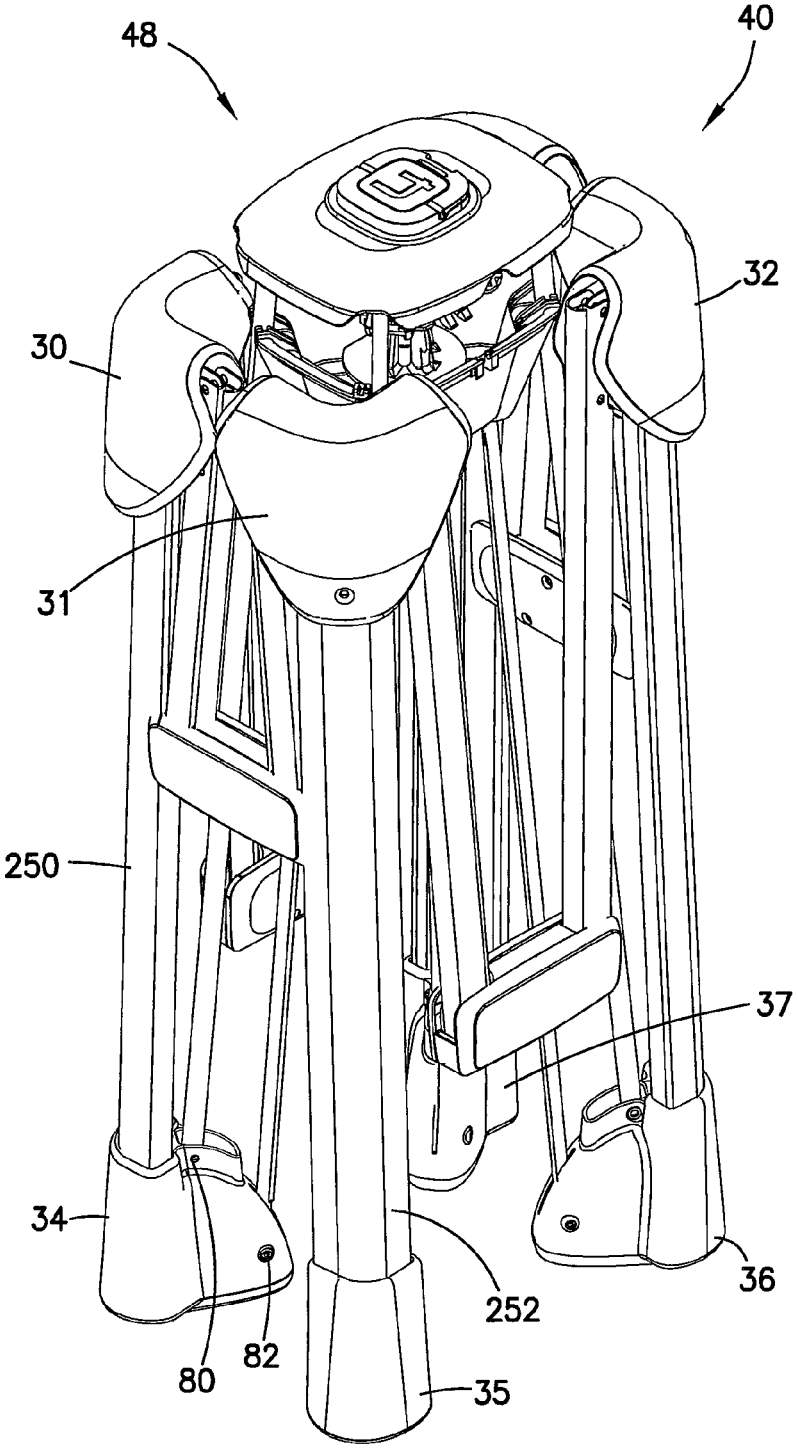
FIG. 5 is a perspective view of the frame in a folded position.

With reference to FIGS. 3-5, to better understand the invention, the detailed description of the foldable frame 40 set forth hereafter may best be understood by dividing the foldable frame 40 into four portions. The frame 40 includes a base assembly, denoted generally as reference numeral 42, forming a lower portion of the frame 40, an upper assembly, denoted generally as reference numeral 44, forming an upper portion of the frame 40, a side structure, denoted generally as reference numeral 46, and a centrally-located hub assembly, denoted generally as reference numeral 48. The base assembly 42 is pivotally connected to both the hub assembly 48 and to the side structure 46, and the upper assembly 44 is pivotally connected to the side structure 46.

The base assembly 42 includes four upper base legs 50, 52, 54, 56, and four lower base legs 60, 62, 64, 66, four lower corners 34, 35, 36, 37, a pair of stability legs 70, 72 and pivot rivets, such as the rivets 80, 82 around which the upper base leg 50 and the lower base leg 60 pivot or rotate relative to the corner 34. Each quarter of the frame is constructed in the same manner so that only the left portion of the frame as shown in FIGS. 3-6 will be detailed. The base legs are configured as shown in an "X" pattern and no side structure or elements are present as in many conventional play yard devices. The lower corners each include a wheel or caster, such as the wheel 86.

The upper assembly 44 includes eight upper arms 140, 142, 144, 146, 148, 150, 152, 154, upper four corner assemblies 30, 31, 32, 33, and four stiffening members 170, 172, 174, 176. As was earlier done, only a portion of the frame will be detailed because all other like structures of the frame are identically configured. The upper arm 140 is pivotally connected to a corner by a rivet 180 and to the stiffening member 170 by a rivet 182. The upper arm 154 that is positioned perpendicular to the upper arm 140 is pivotally connected to the corner by a rivet 184 and to the stiffening member 176 by a rivet 186. The remaining upper arms are arranged in a similar fashion.

The side structure 46 includes four generally vertically disposed side posts 250, 252, 254, 256. Each side post 250, 252, 254, 256 is connected to a respective lower corner and to a respective upper corner. This arrangement permits the side posts to pivot or tilt outwardly and, at the same time, pull the upper corner assemblies outwardly or apart from one another. Each side post also encloses an operative structure that may take the form of a cable as described in greater detail hereinafter. Accordingly, the operative structure is in mechanical communication with the upper arms of the upper assembly and the base assembly to move the upper arms to positions consistent with an opened enclosure and positions consistent with a folded enclosure in response to movement of the base assembly.

Figure 6:
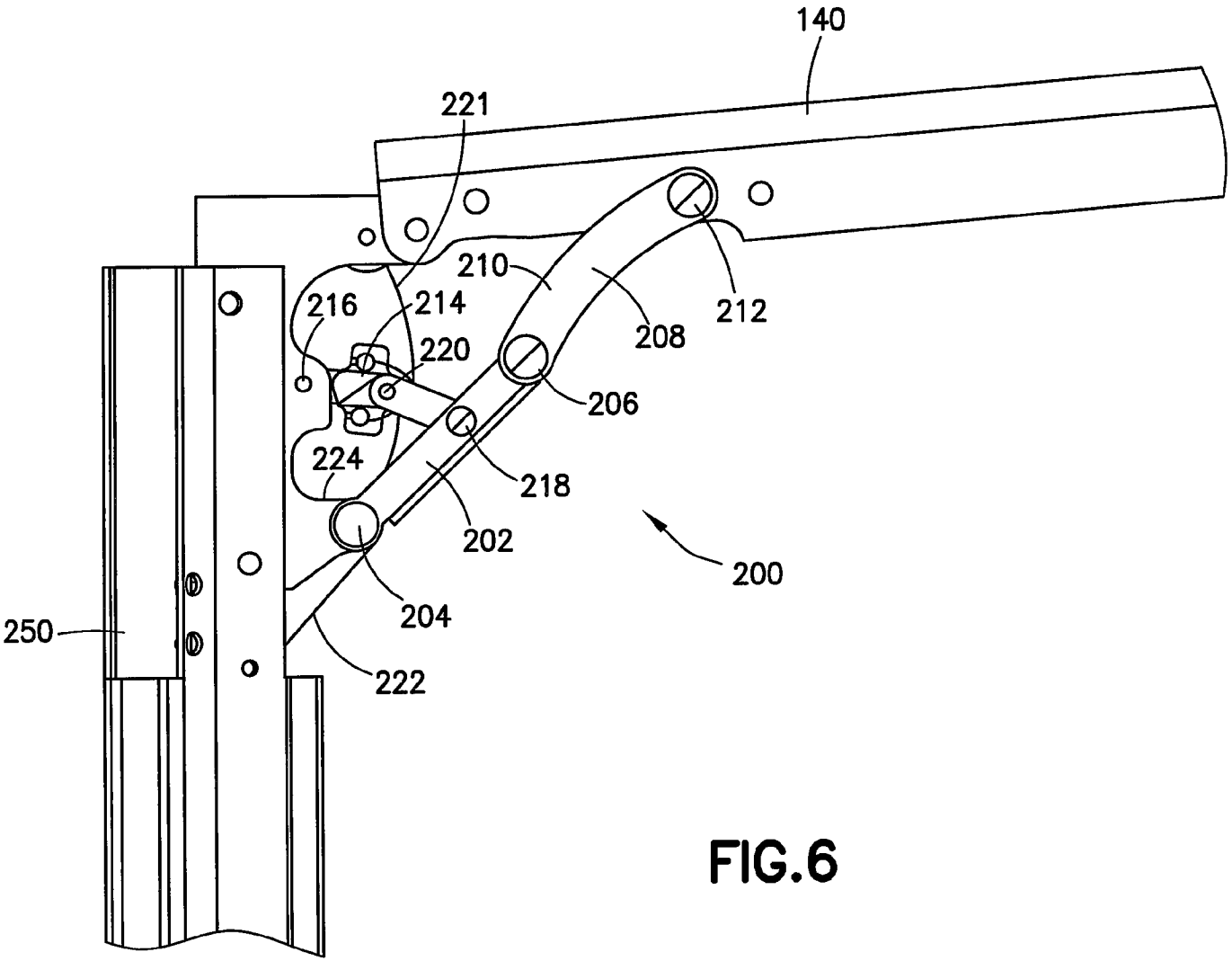
FIG. 6 is a side view of one of the upper corners of the frame of FIG. 3 in the opened position.

Each corner of the foldable frame 40 includes a latching mechanism 200 as can be seen in FIG. 6 where the upper corner 30 has been removed. As was earlier done, only one of the latching mechanisms of the frame will be detailed because all other like latching mechanisms of the frame are identically configured. With reference to FIG. 6, and with continued reference to FIGS. 3-5, the latching mechanism 200 includes a first leg 202 having a first end 204 pivotally connected to and extending from an upper portion of the side post 250 and a second end 206; a second leg 208 having a first end 210 pivotally connected to the second end 206 of the first leg 202 and a second end 212 connected to a portion of the upper arm 140 of the upper assembly 44; and a locking member 214 having a first end 216 pivotally coupled to the upper portion of the side post 250 between an end of the side post 250 and a position where the first end 204 of the first leg 202 is coupled to the upper portion of the side post 250 and a second end 218 connected between the first leg 202 and the second leg 208: The locking member 214 includes a central pivoting member 220 that is operatively coupled to the lower corner 34 by an operating structure, such as a first cable 221 and second cable 222. First cable 221 is secured to a lower end of central pivoting member 220 and extends upward around an upper portion of side post 250 into a hole (not shown) in side post 250 and to the lower corner 34. The second cable 222 extends from an upper end of the central pivoting member 220 over a wheel 224 provided at the first end 204 of the first leg 202, into a hole (not shown) in the side post 250, and to the lower corner 34.

Figure 7:
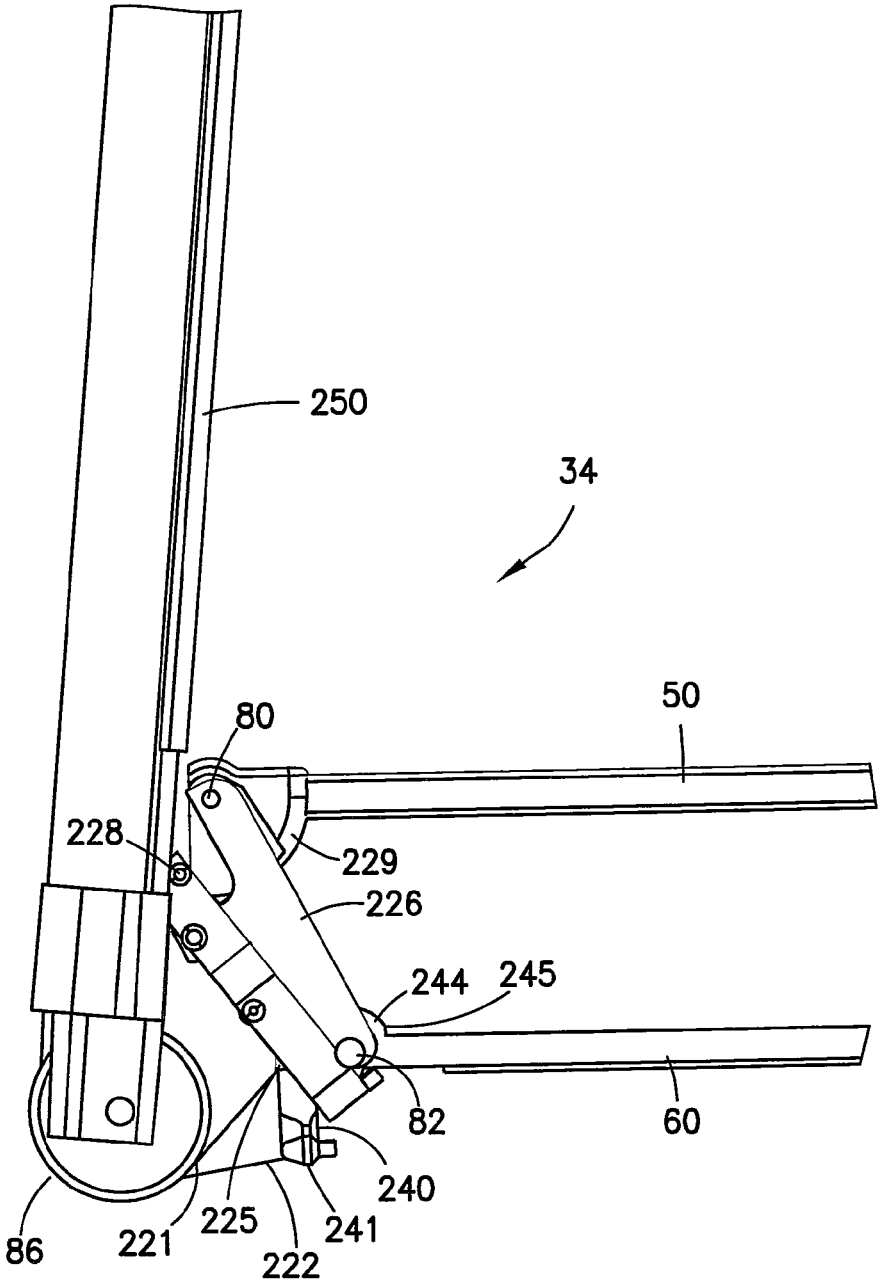
FIG. 7 is a side view of one of the lower corners of the frame of FIG. 3 in the opened position.
Figure 8:
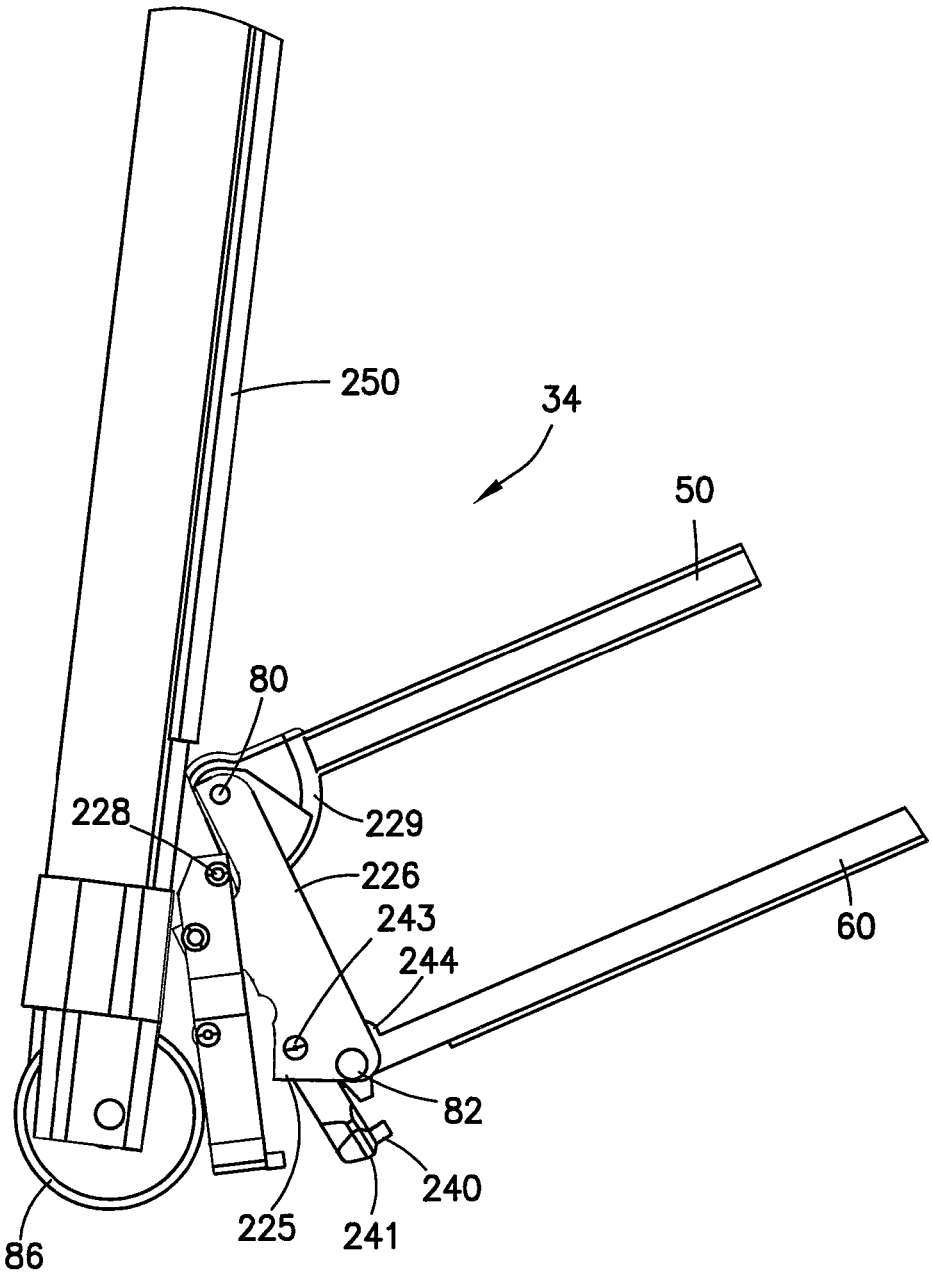
FIG. 8 is a side view of one of the lower corners of the frame of FIG. 4 in the partially-opened position.
Figure 9:
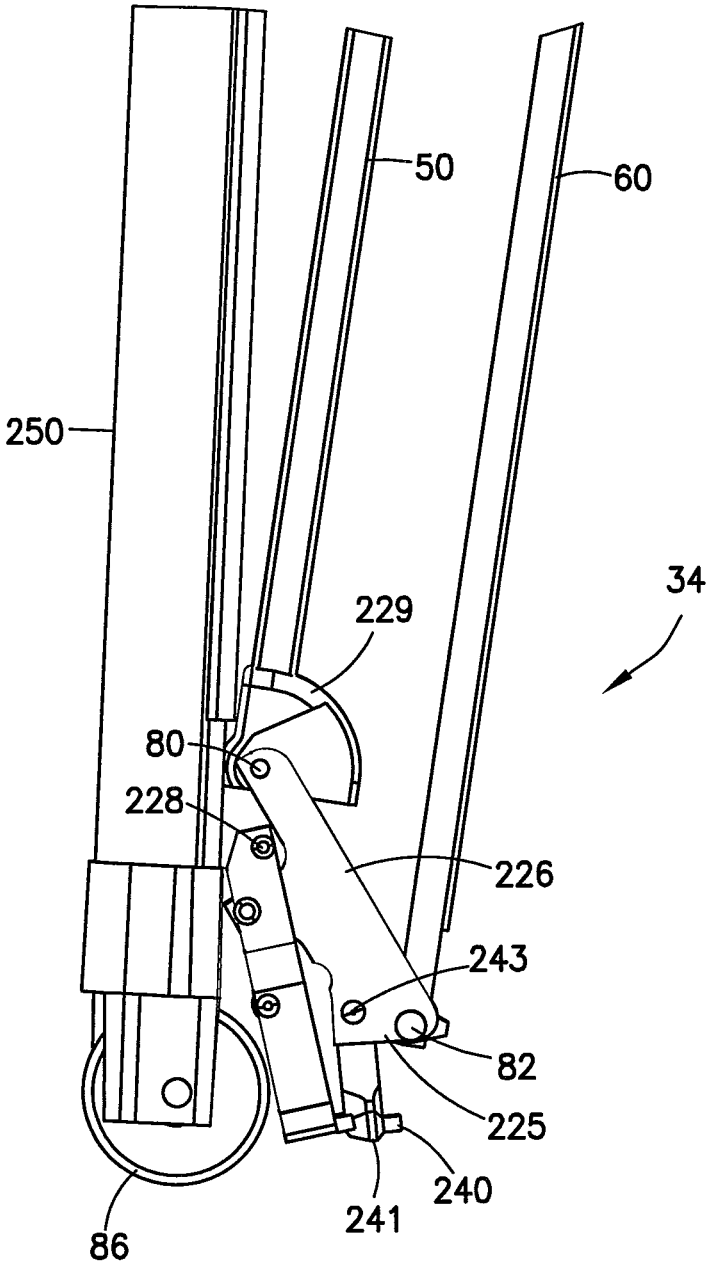
FIG. 9 is a side view of one of the lower corners of the frame of FIG. 5 in the folded position.

With reference to FIGS. 7-9, a side view of one of the lower corners of frame 40 is illustrated in various stages of opening. While a lower corner 34 is used for purposes of illustrating the components in FIGS. 7-9, the remaining three lower corners 35, 36, 37 have identical components and function in an identical way. FIG. 7 shows the lower corner in an opened position with upper base leg 50 and lower base leg 60 in a deployed configuration. FIG. 8 shows the same components illustrated in FIG. 7 in a partially-opened position as frame 40 is advanced from a folded configuration to an opened configuration, or vice versa. FIG. 9 shows the lower corner in a closed position with upper base leg 50 and lower base leg 60 in a folded configuration.

As briefly described hereinabove with regard to FIG. 6, the first and second cables 221, 222 are connected to the central pivoting member 220 of the locking member 214. The cables 221, 222 then extend downward through the side post 250. Referring back to FIGS. 7-9, first cable 221 extends into the lower corner 34 around wheel 86 and is connected to a lower end 241 of a locking link member 240. An upper end 242 of locking link member 240 is pivotally coupled to lower base leg 60 at pivot point 243. Adjacent to the pivot point 243 is a cam 244 provided at a terminal end of lower base leg 60. Cam 244 has a notch 245 to actuate the locking link member 240 to unlock the upper corner. When lower base leg 60 is moved from the folded to the opened position, cam 244 pivots about pivot point 243. A tensioning force in the first cable 221 at lower end 241 of locking link member 240 causes further pivoting of cam 244 about pivot point 243. In a fully opened position, upper end 242 of locking link member 240 slides over the locking notch 245 to lock the lower corner assembly in place. When the lower base leg 60 is moved from the open to the folded position, upper end 242 of locking link member 240 slides over the locking notch 245 to unlock the lower corner assembly, thereby relieving the tensioning force and allowing the latching mechanism 200 to move from the locked position to the nested position discussed hereinabove.

With further reference to FIGS. 7-9, second cable 222 extends into the lower corner 34 around wheel 86 and is connected to a lower end 225 of a plate 226. An upper end 227 of the plate 226 is pivotally coupled to a lower end of the side post 250 at pivot point 228. A camming plate 229 is connected to each upper base leg 50, 52, 54, 56. The camming plate 229 is shaped and sized such that it comes into contact with the plate 226 as the upper base legs 50, 52, 54, 56 are moved from the folded to the open position. As the camming plate 229 comes into contact with the plate 226, it causes the plate 226 to rotate about its pivot point 228 and provide a tensioning force to the second cable 222. This tensioning force is transferred to the latching mechanism 200 to move the latching mechanism 200 to the locked position. When the upper base legs 50, 52, 54, 56 are moved from the open to the folded position, the contact between the camming plate 229 and the plate 226 is removed, thereby relieving the tensioning force and allowing the latching mechanism 200 to move from the locked position to the nested position discussed hereinabove.

Figure 10:
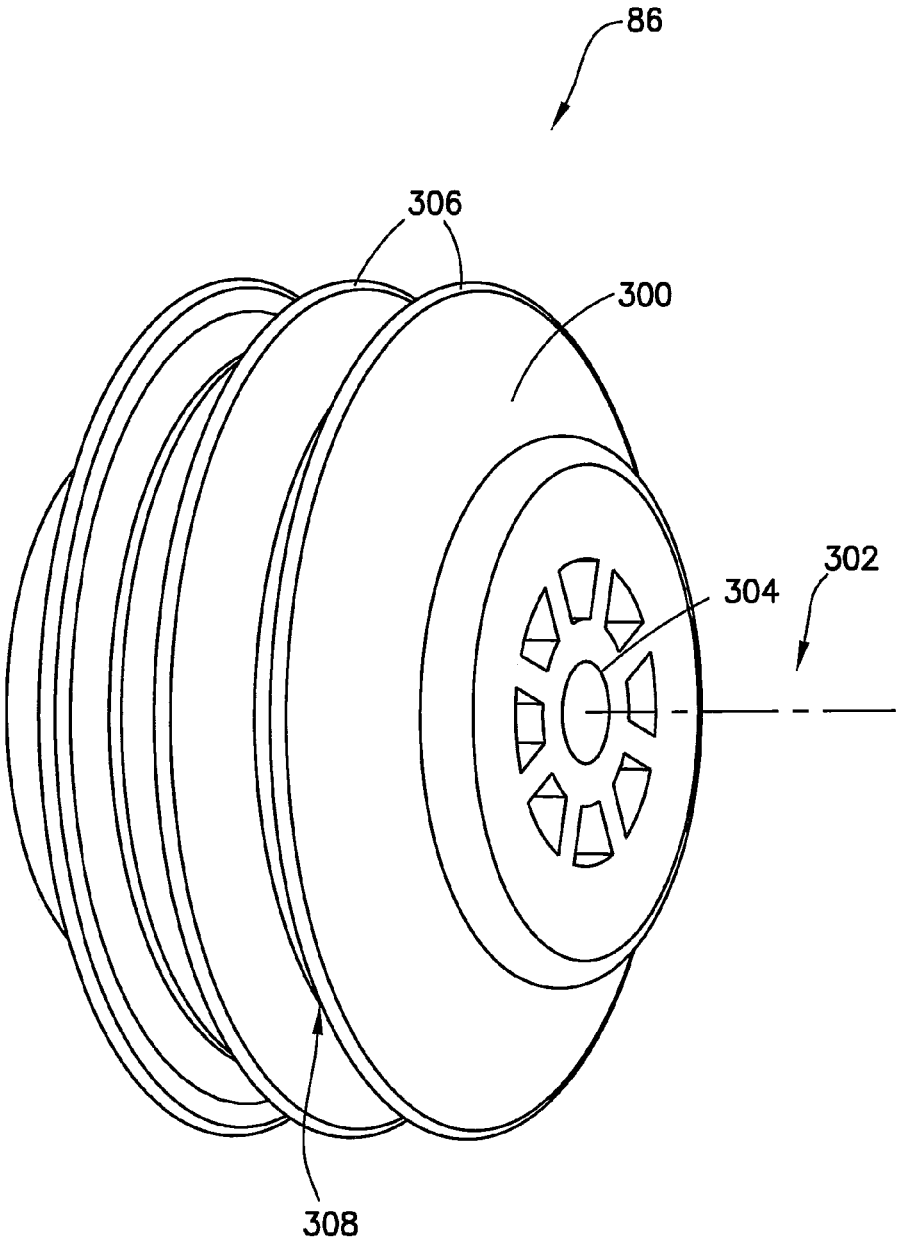
FIG. 10 is a perspective view of a wheel shown in FIGS. 7-9.
Figure 11:
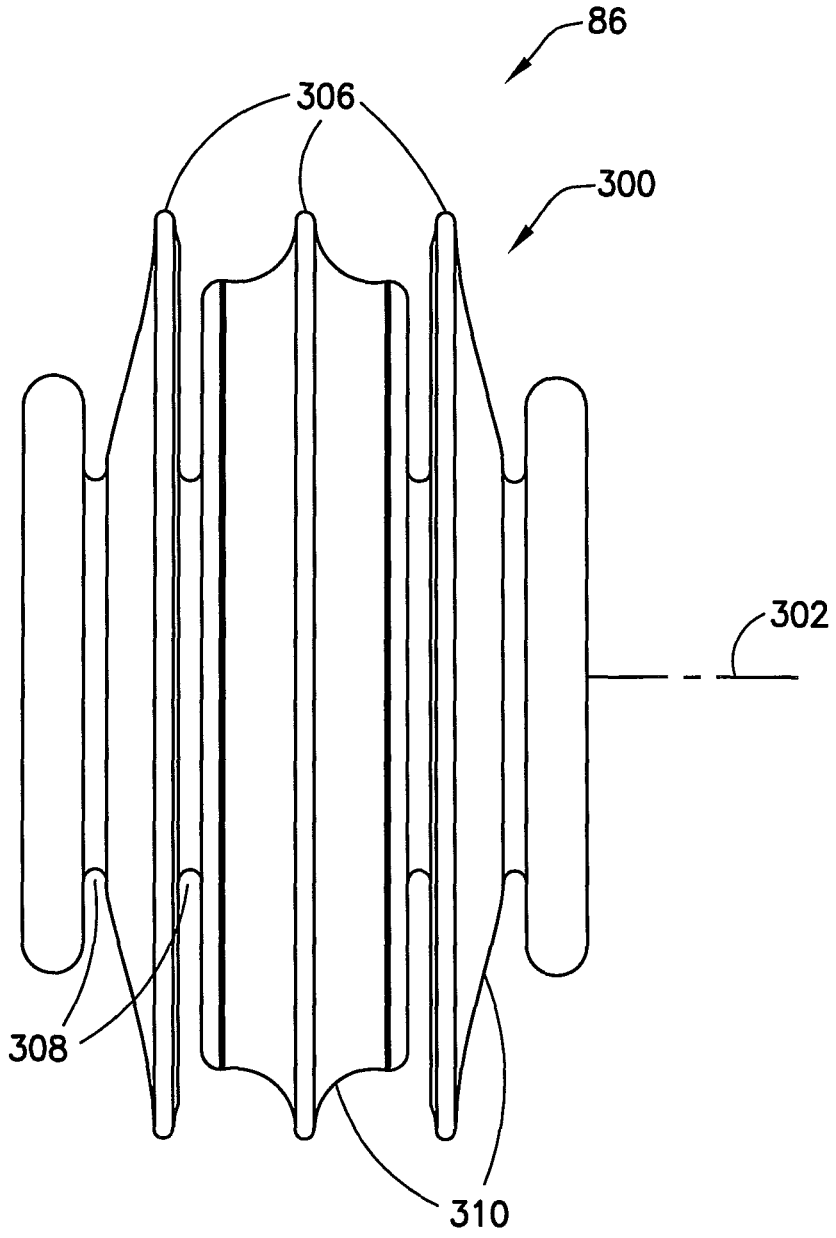
FIG. 11 is a front view of a wheel shown in FIGS. 7-9.

With reference to FIGS. 10-11, the wheel 86 is illustrated separate from the remaining components of the foldable child enclosure apparatus 10. Each wheel 86 is adapted for movably supporting the foldable child enclosure apparatus 10 on a surface, such as flooring or carpeting. The wheel 86 generally includes a wheel body 300 and a central axis 302 about which the wheel 86 rotates. The wheel body 300 has a generally cylindrical shape with the central axis 302 extending through a longitudinal extent of the wheel body 300. An axle opening 304 extends coaxially through the center of the wheel body 300. The axle opening 304 is adapted for receiving an axle (not shown) about which the wheel 86 rotates.

In order to facilitate movement of the foldable child enclosure apparatus 10 across various surfaces, such as thick carpeting or a hard floor surface, the wheel 86 has a plurality of support surfaces 306 adapted for guiding the wheel 86 on the floor surface. As shown in FIGS. 10-11, the support surfaces 306 are provided at an outer periphery of the wheel 86 at an interface between the wheel 86 and a surface, such as carpeting or flooring. The support surfaces 306 are adapted for providing traction so that the wheel 86 can rotate, and the foldable child enclosure apparatus 10 can move, across a plurality of different surfaces. Desirably, at least one support surface 306 is provided for engaging the floor. Each support surface is desirably narrow enough to cut between the fibers of thick carpeting in order to provide adequate traction for moving the wheel 86 through carpeting. Additionally, the plurality of support surfaces desirably have a sufficient footprint to balance the wheel 86 on a smooth and hard surface, such as hardwood flooring or concrete, and evenly distribute the weight of the foldable child enclosure apparatus 10 on such surface.

With continuing reference to FIGS. 10-11, the plurality of support surfaces 306 are separated by a plurality of grooves 308. The grooves 308 are recessed with respect to the support surfaces 306 such that the grooves 308 have a smaller diameter compared to the support surfaces 306. The grooves 308 are adapted for engaging the operating structure, such as the first cable 221 and the second cable 222. The first and second cables 221, 222 are desirably wrapped about at least a portion of the grooves 308. In one embodiment, at least one of the first and second cables 221, 222 engages the grooves 308.

Figure 12:
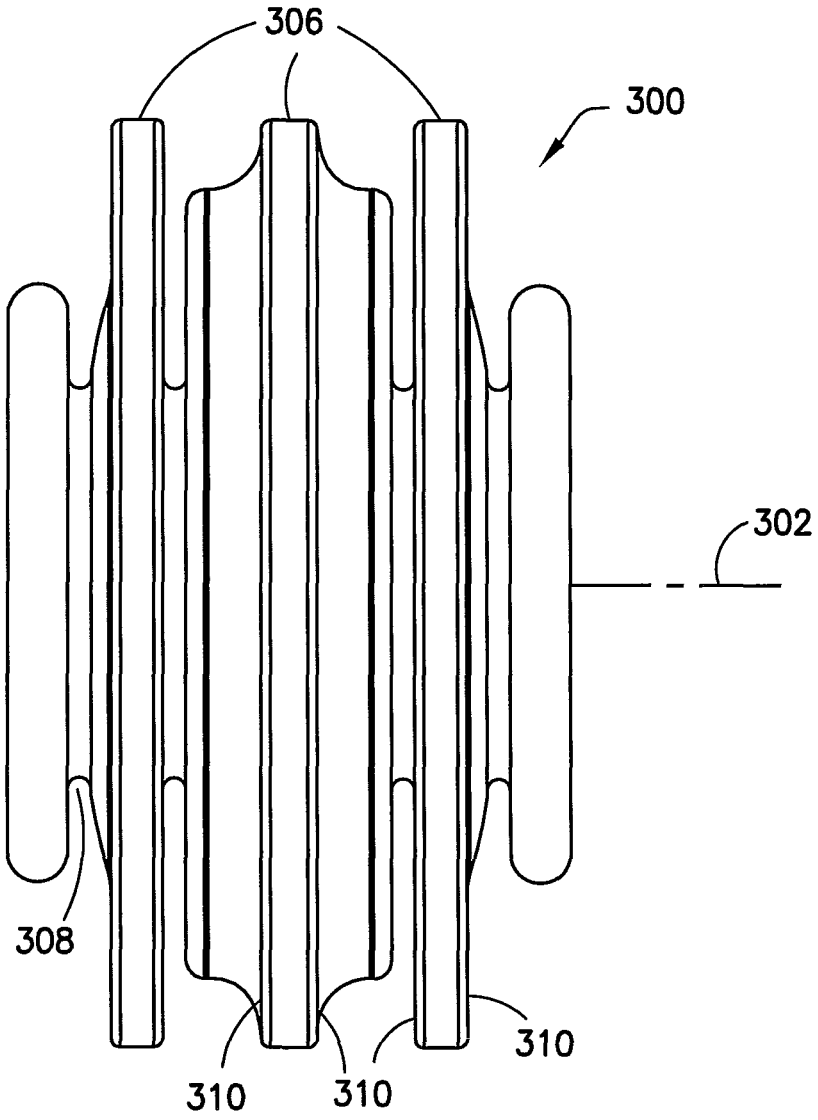
FIG. 12 is a front view of a wheel in accordance with another embodiment of the present invention.

Each support surface 306 desirably has a pair of faces 310 extending on opposing sides of the support surfaces 306. Each face 310 extends between the support surface 306 and the groove 308. One or both faces 310 may be linear or radiused and may be generally angled with respect to the plane of the support surface 306, as shown in FIG. 11. In the embodiment shown in FIG. 12, each face 310 is substantially perpendicular to a plane of the support surface 306. A narrower profile (i.e., a smaller contact patch or footprint) of the support surface 306 is more suitable for enabling wheel 86 to rotate on thick carpeting because the support surface 306 can cut between the carpet fibers. On the other hand, a wider profile (i.e., a larger contact patch or footprint) of the support surface 306 (shown in FIG. 12) is more suitable for enabling wheel 86 to rotate on a smooth, hard surface, such as hardwood flooring or concrete, by providing sufficient traction to the wheel 86 without damaging the floor surface. The number of support surfaces 306 and their profiles are desirably selected for providing a wheel 86 that be rolled through thick carpeting and smooth flooring.

The base legs, upper arms, and side posts may be formed of any suitable tubes, rails, bars, beams, shafts, spars, rods, or the like. Where applicable, any suitable cross-sectional configurations may be used, such as tubular, square, rectangular, I-beam, L-shaped, H-shaped, and C-shaped. Desirably, the side posts have a C-shaped cross-section as shown in the figures. An extrusion of sufficient strength and stiffness should suffice and the material may be plastic or metal or any other suitable material. The upper and lower corners may also be formed of plastic or metal or any other suitable material.

As discussed hereinabove, the operation of the foldable frame 40 can be described as a three-phase process through a single interface. Initially, there is a "spreading" phase, followed by a "lift" phase, and then the last "locking" phase. In the first phase, the user pushes down on the centrally-located hub assembly 48 which causes the legs of the base assembly 42 to spread apart. In the last phase, the legs of the base assembly 42 maintain the side posts of the enclosure at a substantially vertical position. In the final phase, latches provided in the upper corners of the enclosure lock the enclosure in the unfolded or open state.

When the frame is in the opened position, as shown in FIG. 3, the base legs and the upper arms are generally in horizontal positions, and the side posts are generally in vertical positions. When the frame is in the folded position for storage and/or transport, as shown in FIG. 5, the side posts remain in generally vertical positions, and the base legs and the upper arms are pivoted or rotated to more generally vertical positions. It is to be noted that the terms "generally horizontal" and "generally vertical" are meant to indicate approximation and that the referenced structures are at, or near, or about horizontal or vertical.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof

The invention claimed is:

1. A foldable structure comprising:

an upper assembly forming an upper portion of the structure, the upper assembly comprising a plurality of arm assemblies;

a base assembly forming a lower portion of the structure;

a centrally-located hub assembly operatively connected to the base assembly;

a post extending from each corner of the upper assembly to a corner of the base assembly, thereby forming the structure;

an operating structure operatively connected to at least the base assembly; and a wheel assembly provided at each corner of the base assembly extending from the base assembly to engage a surface, each wheel assembly comprising:

a wheel body having a central axis about which the wheel assembly rotates;

at least one support surface adapted for supporting and guiding the wheel body on a surface; and at least one groove provided on opposing sides of the support surface, the at least one groove engages the operating structure, wherein movement of the hub assembly towards a surface upon which the foldable structure is positioned causes the foldable enclosure to move from a folded position to an opened position, and movement of the hub assembly away from the surface causes the foldable structure to move from the open position to the folded position.

2. The foldable structure of claim 1, wherein the hub assembly is operatively connected to an at least one latching mechanism by the operating structure.

3. The foldable structure of claim 2, wherein the operating structure is one or more cables.

4. The foldable structure of claim 2, wherein the posts are hollow and the operating structure extends from the hub assembly to the at least one latching mechanism through at least one of the posts.

5. The foldable structure of claim 2, wherein a plurality of support surfaces are separated by a plurality of grooves.

6. The foldable structure of claim 5, wherein the at least one groove is recessed with respect to the at least one support surface.

7. The foldable structure of claim 5, wherein each support surface has a pair of faces extending on opposing sides of the support surface.

8. The foldable structure of claim 7, wherein at least one face is angled relative to a plane of the support surface.

9. The foldable structure of claim 7, wherein the pair of faces is substantially perpendicular relative to a plane of the support surface.

10. The foldable structure of claim 1, wherein the base assembly comprises upper and lower base legs in an X-shaped configuration.

11. A foldable structure, comprising:

an upper assembly having a plurality of upper arms;

a base assembly having a plurality of base legs;

a side structure having a plurality of side posts connecting the upper assembly to the base assembly;

a centrally-located hub assembly that causes the apparatus to move between a closed position and an open position;

an operating structure operatively connected to at least the base assembly; and a wheel assembly provided at each corner of the base assembly, each wheel assembly comprising:

a wheel body having a central axis about which the wheel assembly rotates;

at least one support surface adapted for supporting and guiding the wheel body on a surface; and at least one groove provided on opposing sides of the support surface, the at least one groove engages the operating structure, wherein the structure is movably supported on a surface by the plurality of wheel assemblies.

12. The foldable structure of claim 11, wherein each support surface has a pair of faces extending on opposing sides of the support surface.

13. The foldable structure of claim 11, wherein the at least one groove is recessed with respect to the at least one support surface.

14. The foldable structure of claim 11, wherein each support surface has a pair of faces extending on opposing sides of the support surface.

15. The foldable structure of claim 11, wherein the base assembly comprises upper and lower base legs in an X-shaped configuration.

16. The foldable structure of claim 11, wherein the operating structure is one or more cables.

17. A foldable structure comprising:

an enclosure defining a space within;

a hub assembly centrally located at a bottom of the structure;

an operating structure for folding the enclosure; and at least one wheel assembly provided at each corner of the foldable structure, wherein each wheel assembly comprises:

a wheel body having a central axis about which the wheel assembly rotates;

at least one support surface adapted for supporting and guiding the wheel body on a surface; and at least one groove provided on opposing sides of the support surface, the at least one groove engages the operating structure.

18. The foldable structure of claim 15, wherein the at least one groove is recessed with respect to the at least one support surface.

* * * * *